US012285790B2

(12) United States Patent
Dagner

(10) Patent No.: US 12,285,790 B2
(45) Date of Patent: Apr. 29, 2025

(54) CHANGING THE EFFECTIVE CONTOUR OF A RUNNING SURFACE OF A WORKING ROLL DURING HOT ROLLING OF ROLLING STOCK IN A ROLL STAND TO FORM A ROLLED STRIP

(71) Applicant: Primetals Technologies Germany GmbH, Erlangen (DE)

(72) Inventor: Johannes Dagner, Erlangen (ER)

(73) Assignee: PRIMETALS TECHNOLOGIES GERMANY GMBH (DE)

( * ) Notice: Subject to any disclaimer, the term of this patent is extended or adjusted under 35 U.S.C. 154(b) by 0 days.

(21) Appl. No.: 18/419,008

(22) Filed: Jan. 22, 2024

(65) Prior Publication Data

US 2024/0173759 A1 May 30, 2024

Related U.S. Application Data

(62) Division of application No. 17/310,246, filed as application No. PCT/EP2020/050684 on Jan. 13, 2020, now Pat. No. 11,919,059.

(30) Foreign Application Priority Data

Jan. 28, 2019 (EP) ..... 19153870
Dec. 30, 2019 (EP) ..... 19219974

(51) Int. Cl.
*B21B 1/22* (2006.01)
*B21B 13/14* (2006.01)
*B21B 27/02* (2006.01)

(52) U.S. Cl.
CPC ..... *B21B 13/142* (2013.01); *B21B 1/22* (2013.01); *B21B 27/021* (2013.01);
(Continued)

(58) Field of Classification Search
CPC ... B21B 1/22; B21B 2001/225; B21B 13/142; B21B 27/021; B21B 2027/022; B21B 2267/18; B21B 2267/24; B21B 31/18
See application file for complete search history.

(56) References Cited

U.S. PATENT DOCUMENTS 4,703,641 A 11/1987 Yarita et al. ..... 72/247
4,776,192 A * 10/1988 Oda ..... B21B 37/40 72/247

(Continued)

FOREIGN PATENT DOCUMENTS

CN 1169342 A 1/1998
CN 1198967 A 11/1998

(Continued)

OTHER PUBLICATIONS

International Search Report mailed Mar. 11, 2020 in corresponding PCT International Application No. PCT/EP2020/050684.

(Continued)

*Primary Examiner* — Edward T Tolan
(74) *Attorney, Agent, or Firm* — OSTROLENK FABER LLP

(57) ABSTRACT

The present invention relates to a method and an apparatus for changing the effective contour of a running surface (8) of a working roller (3, 4) during the hot rolling of rolling stock in a roll stand (2) to form a rolled strip (1). The intention is to be able to change the contour of the running surface (8) during the hot rolling by means of the invention. This object is achieved according to the invention by the axial displacement of the working rollers (3, 4) in opposite directions by a displacement distance s, wherein s is greater or less than $\Delta r/\tan(\alpha)$and $\Delta r$ indicates the wear of the running surface (8) in the radial direction (R) and $\alpha$ indicates the pitch angle of the conical portion (7) of the respective working roller (3, 4).

5 Claims, 4 Drawing Sheets

(52) U.S. Cl.
CPC ... *B21B 2001/225* (2013.01); *B21B 2027/022* (2013.01); *B21B 2267/18* (2013.01); *B21B 2267/24* (2013.01)

(56) References Cited

U.S. PATENT DOCUMENTS

| | | | | |
|---|---|---|---|---|
| 4,864,836 | A | 9/1989 | Ochiai | 72/8 |
| 4,910,988 | A | 3/1990 | Ikeda et al. | 72/247 |
| 5,174,144 | A | 12/1992 | Kajiwara | |
| 5,448,901 | A | 9/1995 | Yu | |
| 5,943,896 | A | 8/1999 | Rosenthal et al. | 72/252.5 |
| 5,970,765 | A | 10/1999 | Seidel | 72/9.1 |
| 7,031,797 | B2 | 4/2006 | Reinschke et al. | |
| 7,757,531 | B2 | 7/2010 | Klöckner et al. | 72/252.5 |
| 7,913,531 | B2 * | 3/2011 | Huang | B21B 27/021 72/252.5 |
| 7,984,634 | B2 | 7/2011 | Marti | |
| 8,713,981 | B2 * | 5/2014 | Inoue | F16N 7/34 72/201 |
| 10,625,317 | B2 | 4/2020 | Seidel et al. | |
| 11,059,083 | B2 * | 7/2021 | Arvedi | B21B 27/02 |
| 11,358,194 | B2 | 6/2022 | Sano | |
| 2003/0177807 | A1 | 9/2003 | Bobig et al. | 72/247 |
| 2008/0163659 | A1 | 7/2008 | Huang et al. | 72/14.8 |
| 2010/0064754 | A1 | 3/2010 | d'Hone | 72/247 |
| 2013/0008220 | A1 | 1/2013 | Minichmayr et al. | 72/224 |
| 2019/0308232 | A1 | 10/2019 | Arvedi et al. | |

FOREIGN PATENT DOCUMENTS

| | | | | |
|---|---|---|---|---|
| CN | 1836801 | A | | 9/2006 |
| CN | 101018623 | A | | 8/2007 |
| CN | 101254508 | A | | 9/2008 |
| CN | 101992215 | A | | 3/2011 |
| CN | 108405628 | A | | 8/2018 |
| DE | 19654068 | A1 | | 6/1998 |
| EP | 0153849 | B1 | | 1/1992 |
| EP | 0276743 | B1 | | 7/1992 |
| EP | 2 548 665 | A1 | | 1/2013 |
| GB | 2 223 435 | A | | 4/1990 |
| GB | 2278306 | A | * | 11/1994 |
| JP | S60-244408 | A | | 12/1985 |
| JP | S61-154709 | A | | 7/1986 |
| JP | S62-259608 | A | | 11/1987 |
| JP | H01-284404 | A | | 11/1989 |
| JP | H01-321007 | A | | 12/1989 |
| JP | 02-187207 | A | * | 7/1990 |
| JP | 04-200812 | A | | 7/1992 |
| JP | H06-277727 | A | | 10/1994 |
| JP | 2761796 | B2 | | 6/1998 |
| JP | 2004-309142 | A | * | 11/2004 |
| JP | 2007/007696 | A | | 1/2007 |
| RU | 2129927 | C1 | | 5/1999 |
| RU | 2615670 | C1 | | 4/2017 |
| SU | 1049130 | A1 | | 10/1983 |
| WO | WO 95/34388 | A1 | | 12/1995 |
| WO | WO 03/078086 | A1 | | 9/2003 |
| WO | WO 2016/146621 | A1 | | 9/2016 |
| WO | WO 2017/215595 | A1 | | 12/2017 |

OTHER PUBLICATIONS

Written Opinion mailed Mar. 11, 2020 in corresponding PCT International Application No. PCT/EP2020/050684.

Abstract of GB 8920640DO, published Oct. 25, 1989, filed by David McKee Sheffield Ltd. entitled "Rolling of Metal Workpieces".

European Notification About Oral Proceedings dated Feb. 6, 2025 issued in corresponding European Patent Application No. 20700385.6.

Valdimir B. Ginzburg: "High-Quality Steel Rolling", Theory and Practice; Jan. 1993.

Masayoshi Sato et al.: IHI Engineering Review "Profile and Flatness Set Up Systems for Rolling Mill"; vol. 42; No. 1; Feb. 2009.

Verlag Stahleisen GmbH, Metallurgical Plant And Technology; "Advanced Automation System For Dragon Steel's New Hot Strip Mill", vol. Jan. 2013; Jan. 2013.

* cited by examiner

CHANGING THE EFFECTIVE CONTOUR OF A RUNNING SURFACE OF A WORKING ROLL DURING HOT ROLLING OF ROLLING STOCK IN A ROLL STAND TO FORM A ROLLED STRIP

CROSS-REFERENCE TO RELATED APPLICATIONS

The present application is a divisional under 37 C.F.R. § 1.53(b) of prior U.S. patent application Ser. No. 17/310,246, filed Jul. 27, 2021, in the name of Johannes Dagner and entitled CHANGING THE EFFECTIVE CONTOUR OF A RUNNING SURFACE OF A WORKING ROLL DURING HOT ROLLING OF ROLLING STOCK IN A ROLL STAND TO FORM A ROLLED STRIP, which is a 35 U.S.C. §§ 371 national phase conversion of PCT/EP2020/050684, filed Jan. 13, 2020, which claims priority of European Patent Application No. 19153870.1, filed Jan. 28, 2019, and claims priority of European Patent Application No. 19219974.3, filed Dec. 30, 2019, the contents of which are incorporated by reference herein. The PCT International Application was published in the German language.

TECHNICAL FIELD

The present invention relates to the technical field of rolling mill technology. The invention specifically relates to hot rolling of rolling stock made of a metallic material, in particular steel or aluminum, the rolling stock being rolled into a rolled strip in a roll stand.

PRIOR ART

WO 2017/215595 A1 discloses that upper and lower working rollers of a roll stand each have a conical portion, an inwardly extending running surface and a cylindrical end. The upper working roller is fitted in the roll stand in the opposite direction to the lower working roller. To prolong a rolling campaign, it is envisaged to displace the working rollers in opposite axial directions during the rolling. In this case, one strip edge of the rolled strip always lies on the edge between the conical portion and the running surface. This measure allows the service life of the working rollers in a rolling process to be extended to 150 km and more without changing or regrinding the working rollers. The publication does not disclose how the effective contour of the running surface of a working roller can be changed during hot rolling of the rolling stock in a roll stand to form a rolled strip.

SUMMARY OF THE INVENTION

The object of the invention is to provide a method and an apparatus for changing the effective contour of a running surface of a working roller during hot rolling of rolling stock in a roll stand between two working rollers to form a rolled strip.

Since the running surfaces wear during the hot rolling, the contour of the working roller during operation is generally different than the initial contour of the working roller, that is, the contour of the working roller prior to the beginning of the hot rolling. The effective contour of a running surface of a working roller means the contour that the running surface of a working roller (which is not axially displaced during the hot rolling) would have to have so that a determined profile or a determined planarity for the rolled strip is produced during the hot rolling of rolling stock.

On the one hand, the object according to the invention is achieved by a method for reducing an effective contour of a running surface of a working roller during the hot rolling of rolling stock in a roll stand to form a rolled strip, wherein the roll stand comprises:

- an upper working roller and a lower working roller, wherein each working roller has two ends for rotational mounting of the working roller in chocks,
- each working roller in an axial direction thereof has a conical portion followed by a running surface,
- the running surfaces of the working rollers have a non-cylindrical initial contour prior to the hot rolling;
- the upper working roller is fitted in the opposite direction to the lower working roller,
- each working roller has a separate displacing device for axially displacing the working roller, comprising the method steps of:
- hot rolling the rolling stock between the two working rollers, wherein the radial extent of the running surface of a working roller decreases by □r during the rolling,
- axially displacing the working rollers in opposite directions by a displacement distance $$s > \frac{\Delta r}{\tan(\alpha)},$$

where Δr indicates the wear of the running surface in a radial direction and α indicates the pitch angle of the conical portion of the respective working roller.

As a result of "reducing the effective contour", the contour of the running surface is flattened or leveled, that is the effective contour becomes flatter as a result. This makes it possible to reduce for example the so-called strip crown, for example C0, C25, C40.

The roll stand and the working rollers of the roll stand are configured, for example, as shown in FIG. 1 of WO 2017/215595. In the present invention, however, it is not absolutely necessary that the running surfaces of the working rollers made to be inwardly extending. The rolling stock is hot-rolled in the rolling gap between the upper working roller and the lower working roller of the roll stand, such that the working rollers are worn by their contact with the rolling stock. Specifically, the radius of the running surfaces decreases by Δr due to the wear of the working rollers. In order to avoid worn edges in the running surfaces of the working rollers, the working rollers are respectively displaced in opposite axial directions. For example, the upper working roller is displaced to the right and the lower working roller is displaced to the left. If a respective working roller is displaced by a displacement distance $$s > \frac{\Delta r}{\tan(\alpha)},$$

the effective contour of the running surface is reduced. As a result, the reduction of the profile or the planarity of the rolled strip is influenced in a targeted manner. The reduction in the effective contour has the effect that the strip becomes somewhat thicker in the region of the strip edges, which has a direct and immediate effect on the profile or the planarity of the strip. Δr indicates the wear of the running surface of a working roller in the radial direction and α indicates the pitch angle of the conical portion of the respective working roller.

In an equivalent manner, for reducing an effective contour of a running surface of a working roller during the hot rolling of rolling stock in a roll stand to form a rolled strip, the axial displacement rate v, i.e. the first time derivative of the displacement distance s, of the working roller may be set to a value $$v \equiv \dot{s} > \frac{\dot{\Delta} r}{\tan(\alpha)}.$$

Δ'r indicates the rate of wear of the running surface of a working roller in the radial direction.

It is possible that the displacement rate v is set to a value greater than Δ'r/tan(α)over a relatively long time, or that the displacement rate v is only set to a value greater than Δ'r/tan(α) within a limited time window during operation.

On the other hand, the object according to the invention is achieved by a method for increasing an effective contour of a running surface of a working roller during the hot rolling of rolling stock in a roll stand to form a rolled strip. That roll stand comprises:

- an upper working roller and a lower working roller, wherein each working roller has two ends for the rotational mounting of the working roller in chocks,
- in the axial direction, each working roller has a conical portion followed by a running surface,
- the running surfaces of the working rollers have a non-cylindrical initial contour prior to the hot rolling;
- the upper working roller is fitted in the opposite direction to the lower working roller,
- each working roller has a separate displacing device for axially displacing the working roller, comprising the method steps of:
- hot rolling the rolling stock between the two working rollers, wherein the radial extent of the running surface of a working roller decreases by Δr during the rolling,
- axially displacing the working rollers in opposite directions by a displacement distance $$0 < s < \frac{\Delta r}{\tan(\alpha)},$$

where Δr indicates the wear of the running surface in the radial direction and α indicates the pitch angle of the conical portion of the respective working roller.

The "increasing of an effective contour" achieves the opposite effect to the "reducing of an effective contour". In other words, the method makes the effective contour steeper. This makes it possible, for example, to increase the so-called strip crown, for example C0, C25, C40.

Also in the case of the embodiment hereof, the roll stand and the working rollers of the roll stand may be configured for example as shown in FIG. 1 of WO 2017/215595. Here, too, it is not absolutely necessary that the running surface of the working rollers is made to be inwardly extending. In contrast, a respective working roller is displaced by a displacement distance $$0 < s < \frac{\Delta r}{\tan(\alpha)}.$$

As a result, the effective contour of the working rollers is increased or this contour is made steeper. As a result, the profile or the planarity of the rolled strip is influenced in a targeted manner. The increase in the effective contour has the effect that the strip becomes somewhat thinner in the region of the strip edges, which has a direct and immediate effect on the profile or the planarity of the strip. □r once again indicates the wear of the running surface of a working roller in the radial direction and a indicates the pitch angle of the conical portion of the respective working roller.

In a manner equivalent thereto, for increasing the effective contour of a rolled strip as claimed in claim 4, the axial displacement rate v, i.e. the first time derivative of the displacement distance s, of the working roller may be set to a value $$\theta < v \equiv \dot{s} < \frac{\dot{\Delta} r}{\tan(\alpha)}.$$

Δ'r indicates the rate of wear of the running surface of a working roller in the radial direction.

Here, too, it is possible that the displacement rate v is set to a value greater than 0 and less than Δ'r/tan(α)over a relatively long time, or that the displacement rate v is only set to a value greater than 0 and less than Δ'r/tan(α)within a limited time window during operation.

Consequently, the disclosed methods as claimed in a first group of claims cover opposite objectives in comparison with a second group of the claims. According to the first group of claims, the effective contour of a running surface of a working roller is reduced, whereas, according to the second group of claims, the effective contour of a running surface of a working roller is increased.

In particular, in the case of hot rolling of very thin strips, for example strips having a thickness of between 0.5 and 2 mm, in a roll stand, especially the planarity and, to a lesser extent, the profile of the strip is influenced by the methods according to the invention. This is because the so-called transverse flow is small in the case of very thin strips. By contrast, when applying the methods according to the invention in the case of strips having a thickness of>2 mm, especially the profile and to a lesser extent the planarity of the strip is influenced.

In studies carried out by the applicant, it has been found that the profile and/or the planarity of the rolled strip can be influenced in a targeted manner by the axial displacement distance s or the axial displacement rate v of the working rollers in dependence on the wear Δr or the rate of wear Δ'r. It has thus been found that axial displacement of a working roller by a displacement distance $$s > \frac{\Delta r}{\tan(\alpha)}$$

or a displacement rate $$v \equiv \dot{s} > \frac{\dot{\Delta} r}{\tan(\alpha)}$$

leads to a reduction or to the flattening of an effective contour. The effective contour becomes flatter as a result. On the other hand, it has been found that an axial displacement of a working roller by a displacement distance $$0 < s < \frac{\Delta r}{\tan(\alpha)}$$

or a displacement rate $$\theta < v \equiv \dot{s} < \frac{\dot{\Delta} r}{\tan(\alpha)}$$

leads to an increase or to the steepening of the effective contour.

The object according to the invention is likewise achieved by an apparatus for changing an effective contour of a running surface of a working roller during the hot rolling of rolling stock in a roll stand to form a rolled strip in, wherein the roll stand comprises:

- an upper working roller and a lower working roller, wherein each working roller has two ends for the rotational mounting of the working roller in chocks,
- each working roller in the axial direction has a conical portion followed by a running surface,
- the running surfaces of the working rollers have a non-cylindrical initial contour prior to the hot rolling,
- the upper working roller is arranged in the opposite direction to the lower working roller,
- a respective separate displacing device for the upper working roller and for the lower working roller for the axial displacement of the working roller,
- a device for determining the wear Δr or the rate of wear Δ'r of the running surface of at least one working roller in the radial direction, The apparatus according to the invention is suitable both for reducing and for increasing an effective contour of a running surface of a working roller during the hot rolling of rolling stock between the two working rollers in a roll stand. The reduction or increase in the effective contour makes it possible to influence the profile and/or the planarity of the strip in a targeted manner.

The wearing of the running surface in the radial direction is determined by the device for determining the radial wear or the rate of wear Δ'r of the running surface of the working rollers. The determination may either be performed by measuring technology, or preferably with the aid of a wear model, which for example takes into account the rolling force F, the distance covered by the working roller sextent and/or the rolling time. The distance covered by the working roller is determined according to $s_{extent}$=r,φ, where φ indicates the angle in radians for the revolutions covered by the working roller. For further details of the wear model, reference is made to EP 2 548 665 B1.

For an advantageous embodiment, the device for determining the wear Δr or the rate of wear Δ'r of the running surface is connected to a thickness measuring device for measuring the thickness of the rolled strip and to a device for determining the distance between the upper working roller and the lower working roller. The distance, typically vertical distance, between the working rollers and the measured thickness of the strip can be used to determine the wear or the rate of wear.

According to an alternative embodiment, the device for determining the wear Δr or the rate of wear Δ'r of the running surface has a wear model (see EP 2 548 665 B1), wherein the wear model is connected at least to one from the group comprising a rolling force measuring instrument for determining the rolling force F, the distance covered by the working roller $s_{extent}$ and a timer for determining the rolling time.

Preferably, one apparatus also has a measuring instrument for determining the profile and/or the planarity of the rolled strip, wherein the measuring instrument is arranged downstream of the roll stand in the direction of mass flow.

In this case, it is advantageous if the control device for axially displacing the working rollers in opposite directions, depending on the wear or the rate of wear of the working rollers, also takes account of the measured profile PRactual and/or the measured planarity PLactual of the rolled strip. In this case, the control device is connected in signaling terms to the device for determining the wear or the rate of wear and to the measuring instrument for determining the profile and/or the planarity of the rolled strip.

The displacing device itself may be for example an electromechanical drive (for example a recirculating ball screw with an electric motor) or a hydraulic drive.

For the rolling of thin steel strips, it is advantageous if the initial contour of a running surface is a parabolic contour having a depth of 100 to 300 μm, wherein the central region is thinner than a peripheral region of the parabolic contour.

BRIEF DESCRIPTION OF THE DRAWING(S)

Further advantages and features of the present invention emerge from the following description of non-restrictive exemplary embodiments, wherein, in the figures.

Figures 3A, 3B, 3C:
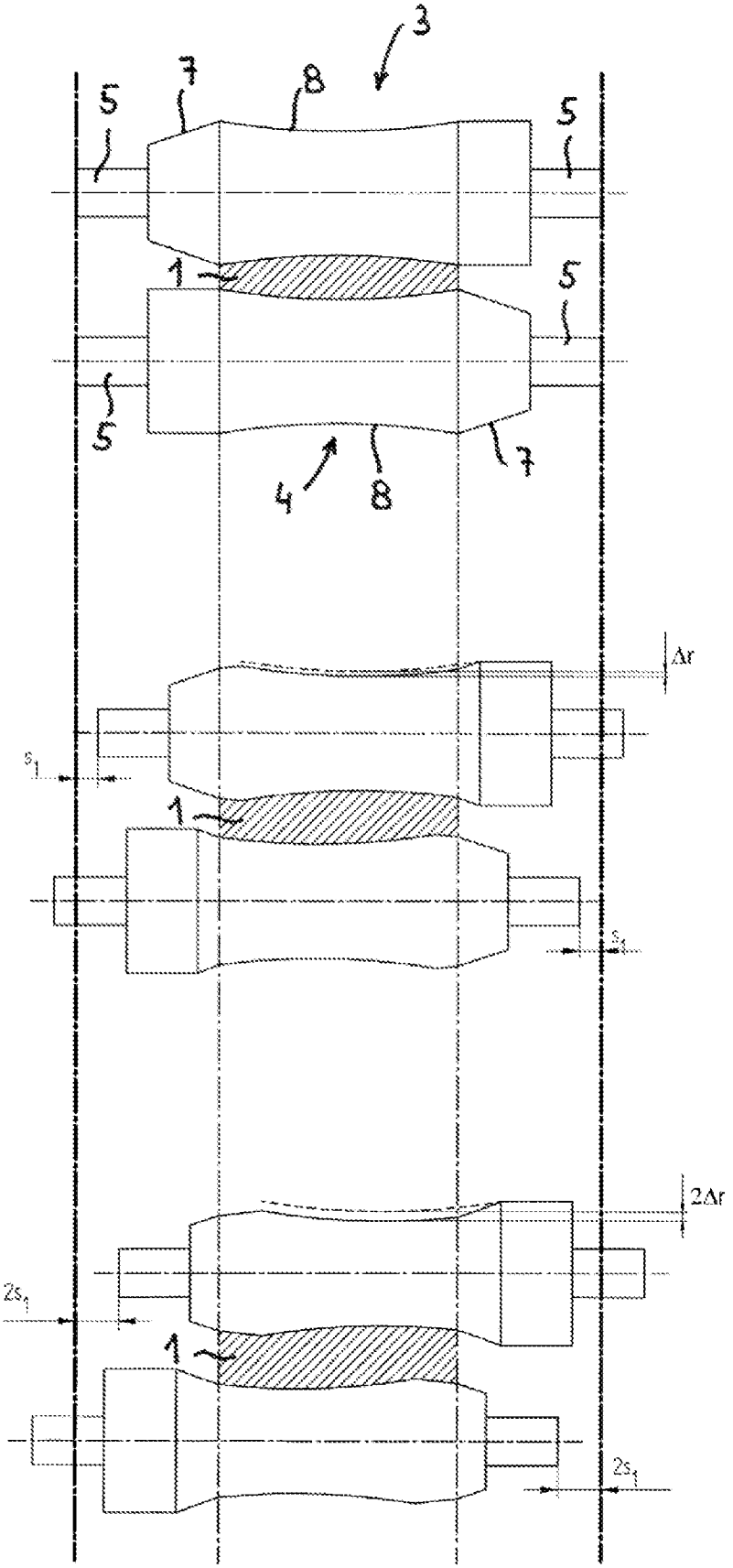

FIG. 3*a*, 3*b*, 3*c* show an illustration of a method according to the invention for reducing the effective contour during the hot rolling of rolling stock to form a strip in a roll stand.

Figures 4A, 4B, 4C:
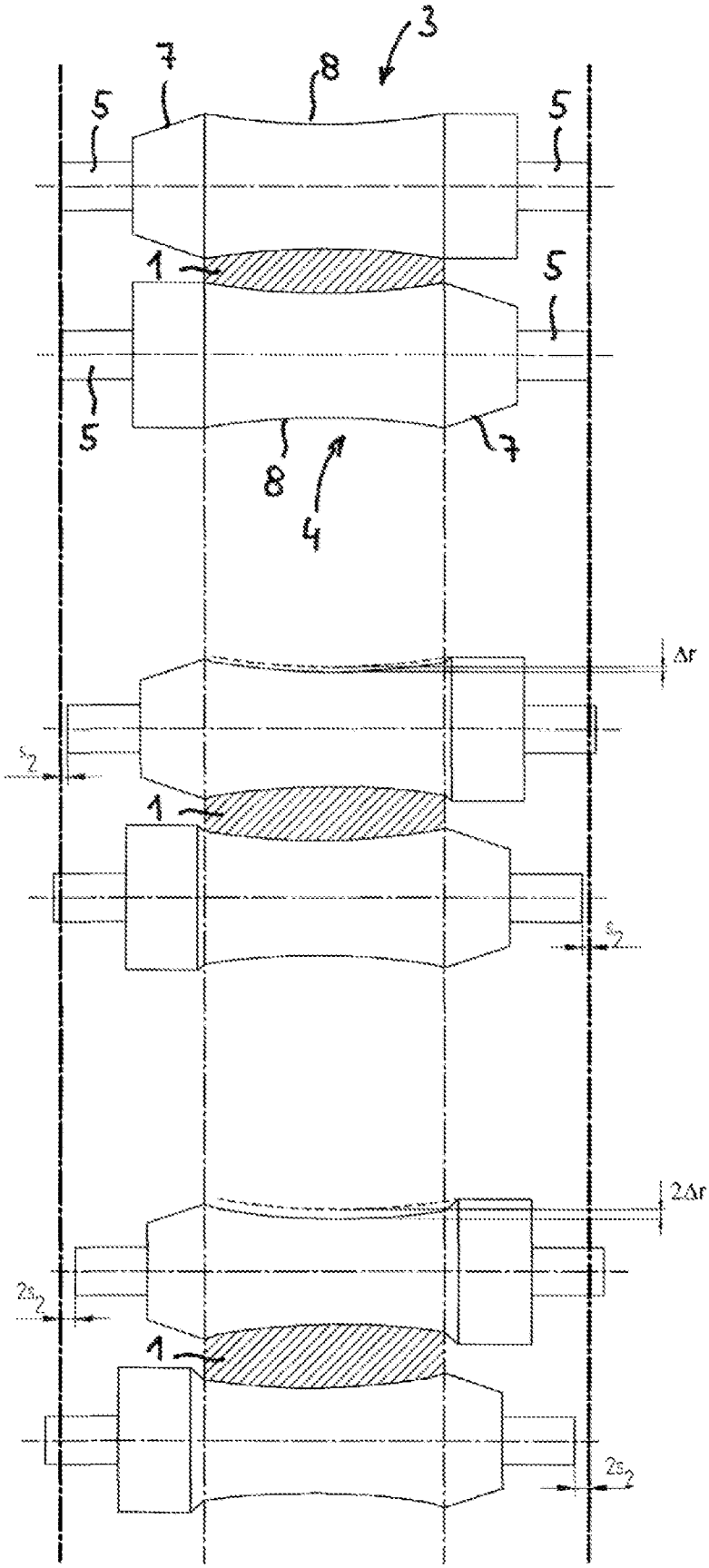

FIG. 4*a*, 4*b*, 4*c* show an illustration of a method according to the invention for increasing the effective contour during the hot rolling of rolling stock to form a strip in a roll stand.

Figure 5:
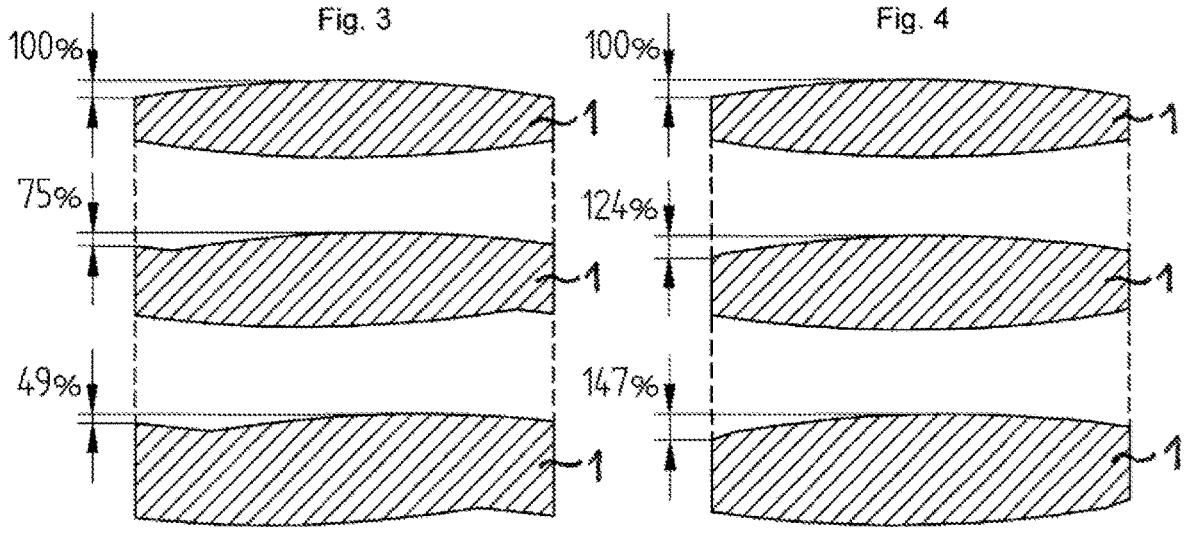

FIG. 5 shows a comparison of the strip profiles from FIG. 3 with FIG. 4.

Figure 6:
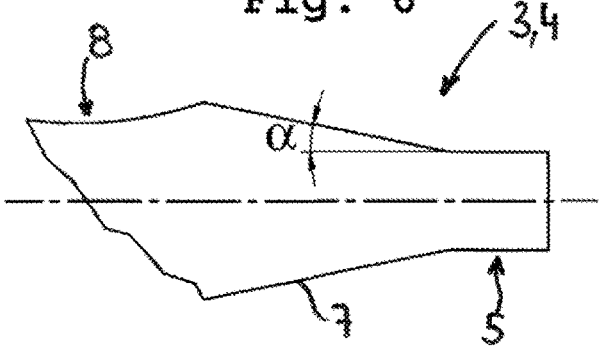

FIG. 6 shows a schematic illustration of a portion of a working roller.

DESCRIPTION OF THE EMBODIMENTS

Figure 1:
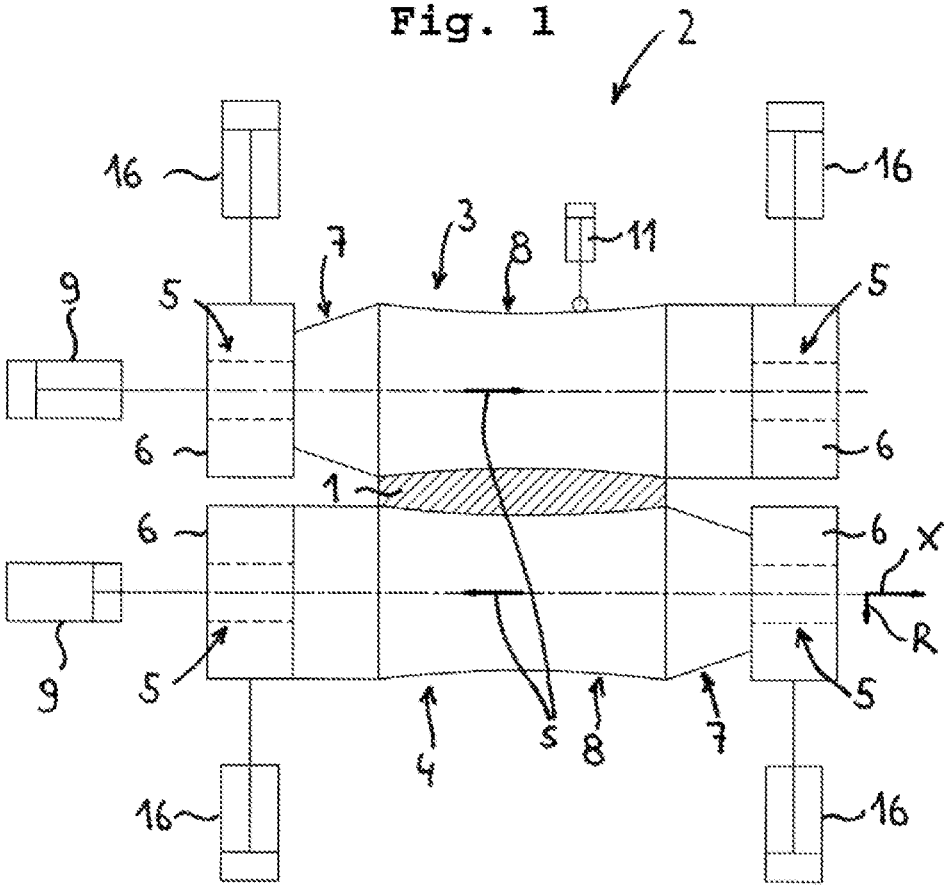
FIG. 1 shows a schematic illustration of a roll stand having an upper working roller and a lower working roller for changing an effective contour of a running surface of a working roller during the hot rolling of rolling stock to form a strip.

FIG. 1 schematically shows a roll stand 2 as part of an apparatus for changing the effective contour of a running surface 8 of a working roller 3, 4 during the hot rolling of rolling stock in a roll stand 2 to form a rolled strip 1. The changing, i.e. the reducing or the increasing, of the effective contour makes it possible to influence the profile and/or the planarity of the strip 1 during the hot rolling. The rolling stock is hot-rolled in the rolling gap between the upper working roller 3 and the lower working roller 4. Each working roller 3, 4 has two ends 5, which are each fitted displaceably in a chock 6 in a roller housing (not illustrated) of the roll stand 2. Furthermore, each working roller 3, 4 comprises a conical portion 7 and a running surface 8 (see also FIG. 6). The upper working roller 3 is fitted in the roll stand 2 in the opposite direction to the lower working roller 4. The upper working roller 3 and the lower working roller 4 can be displaced in the axial direction by way of separate displacing devices 9 during operation. The upper working roller 3 is displaced to the right during operation, while the lower working roller 4, on the other hand, is displaced to the left (see arrows of the displacement distance s). Furthermore, the rolling gap between the upper working roller 3 and the lower working roller 4 can be set by adjusting devices 16. In order to be able to ascertain the wear of the running surface 8 of the upper working roller 3 during operation, the upper working roller has a device for determining the wear 11 or the apparatus according to the invention has a wear model. A single device 11 or a single wear model is sufficient if the working rollers 3, 4 are produced from the same material. Of course, it is likewise possible that the upper working roller 3 and the lower working roller 4 each have a separate device for determining the wear 11 or a separate wear model. This may be expedient if the working rollers 3, 4 are operated at different rates during the hot rolling. In this document, however, it is to be assumed that the working rollers 3, 4 are composed of the same material and are operated at the same rate. The measurement of the wear Δr or the rate of wear Δ'r of the running surface 8 of the working rollers 3, 4 in the radial direction may be performed with contact, for example by a roller which contacts the running surface 8, or without contact, for example optically. Since the axial displacement of the working rollers in the roll stand to compensate for wear is already known from WO 2017/215595 A1, details with respect to this are incorporated by reference to this document. However, it is not known from this document how the effective contour can be changed in a targeted manner during the rolling of a strip.

In the Figures that follow, the backup rollers are not illustrated for reasons of overall clarity. Any person skilled in the art in the field of rolling mill technology knows that backup rollers are customary and counteract bending of the working rollers.

Figure 2:
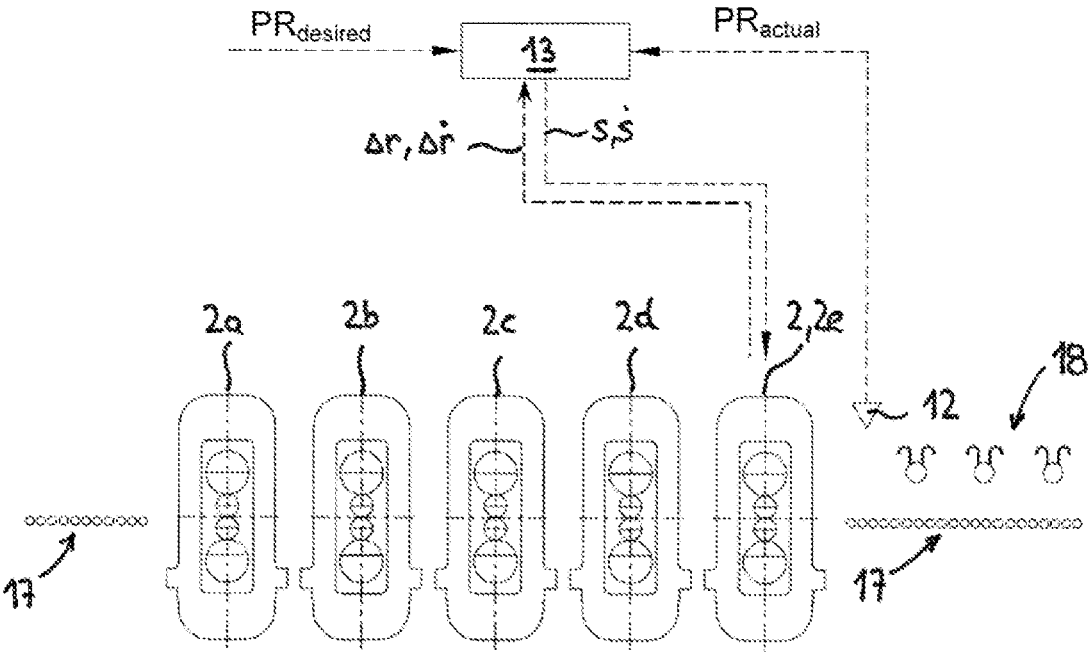
FIG. 2 shows a schematic illustration of an apparatus according to the invention for changing an effective contour of a running surface of a working roller during the hot rolling of rolling stock to form a strip with the roll stand as shown in FIG. 1.

FIG. 2 schematically illustrates an apparatus for changing the effective contour of a running surface of a working roller during the hot rolling of rolling stock in a roll stand 2 of a five-stand finishing rolling mill train, for example in a combined casting and rolling installation. The rolling stock (not illustrated) is fed by way of a roller table 17 to the finishing rolling mill train with the roll stands 2*a* to 2*e* and finish-rolled there in the hot state. In the last roll stand 2, 2*e*, the wear Δr or the rate of wear Δ'r of the running surfaces 8 of the working rollers 3, 4 is ascertained by measuring technology by the device 11 (see FIG. 1). Alternatively, it is likewise possible not to ascertain the ascertainment of Δr or Δ'r by measuring technology, but rather by using a so-called wear model. The apparatus also comprises a measuring instrument 12 for determining the profile or the planarity of the rolled strip. This measuring instrument is arranged downstream of the roll stand 2 in the direction of mass flow. In the specific case, the actual profile PRactual is fed to a control device 13. In addition to the actual profile, the desired profile PRdesired is also fed to the control device 13. Taking into account the wear Δr or the rate of wear Δ'r, and optionally, the measured profile PRactual and the desired profile PRdesired, the control device 13 calculates the displacement distance s or the displacement rate ṡ for the upper working roller 3 and the lower working roller 4 (see FIG. 1). The effective contour of the working rollers can be changed in a targeted manner by axially displacing the working rollers 3, 4 more quickly or more slowly. For very thin strips, this has an effect especially on the planarity of the strip. In contrast thereto, for thicker strips, the changing of the effective contour has an effect especially on the profile of the rolled strip. After the finish-rolling, the rolled strip is cooled down in a cooling section 18 and subsequently conveyed out, for example by being rolled up.

The methods for changing the effective contour of a running surface of a working roller during the hot rolling of a rolled strip are explained below with reference to FIGS. 3*a*-3*c* and 4*a*-4*c*.

In FIG. 3*a*, a strip 1 is hot-rolled in the rolling gap between the upper working roller 3 and the lower working roller 4. At the beginning, the strip has an initial thickness. The two working rollers 3, 4 each have two ends 5, a conical portion 7 and a running surface 8. The upper working roller 3 is fitted in the opposite direction to the lower working roller 4.

After a certain rolling time, the running surfaces 8 of the working rollers 3, 4 are worn in the radial direction by an amount Δr (see FIG. 3*b*). If the vertical distance between the two working rollers 3, 4 is kept constant, the rolled strip 1 becomes thicker by about 2 Δr as a result. Continuing the hot rolling has the effect that the running surfaces 8 of the working rollers 3, 4 are worn by the amount 2. Δr (see FIG. 3*c*), such that the strip becomes thicker by about 4Δr.

It is possible to compensate for the change in thickness of the rolled strip 1 by an adjustment of at least one working roller 3 or 4 (see WO 2017/215595 A1).

In FIG. 3*a*-3*c*, the working rollers 3, 4 are axially displaced such that the displacement distance s of the working rollers 3, 4 in the axial direction corresponds to the condition $$s = 2\frac{\Delta r}{\tan(\alpha)},$$

where Δr indicates the wear of a working roller 3, 4 in the radial direction and α indicates the pitch angle of the conical portion. In an equivalent manner, the displacement may be set out as governed by the rate of wear Δ'r, the working rollers 3, 4 then being displaced in the axial direction at an axial rate of $$v \equiv \dot{s} = 2\frac{\dot{\Delta} r}{\tan(\alpha)}.$$

According to FIG. 3*b*, the wear of the running surface 8 of the working rollers 3, 4 is Δr. This gives a displacement distance of $$s1 = 2\frac{\Delta r}{\tan(\alpha)}.$$

According to FIG. 3*c*, the wear of the running surface 8 of the working roller 3, 4 is 2. Δr. This provides a displacement distance of $$2.s1 = 4\frac{\Delta r}{\tan(\alpha)} s1 = 2\frac{\Delta r}{\tan(\alpha)}.$$

The upper working roller 3 is in this case displaced to the right and the lower working roller 4 to the left.

As can be seen from the left-hand partial image from FIG. 5, this method has the effect that the distance between the contour of the strip 1 between the two edges and the contour of the strip 1 at the edges decreases over time. In other words, the effective contour of the working rollers 3, 4 becomes flatter or the effective contour of the working rollers 3, 4 is reduced.

In FIG. 4*a*-4*c*, the working rollers 3, 4 are axially displaced such that the displacement distance of the working rollers 3, 4 in the axial direction corresponds to the condition $$s = \frac{1}{2}\frac{\Delta r}{\tan(\alpha)},$$

where Δr indicates the wear of a working roller 3, 4 in the radial direction and α indicates the pitch angle of the conical portion. In an equivalent manner, the displacement may be set as governed by the rate of wear Δ'r, a working roller 3, 4 then being displaced in the axial direction at an axial rate of $$v \equiv \dot{s} = \frac{1}{2}\frac{\dot{\Delta} r}{\tan(\alpha)}.$$

According to FIG. 4*b*, the wear of the running surface 8 of the working roller 3, 4 is Δr; this gives a displacement distance of $$s2 = \frac{1}{2}\frac{\Delta r}{\tan(\alpha)}.$$

According to FIG. 4*c*, the wear of the running surface 8 of the working roller 3, 4 is 2. Δr; this gives a displacement distance of $$2.s2 = 2\frac{1}{2}\frac{\Delta r}{\tan(\alpha)} = \frac{\Delta r}{\tan(\alpha)} s1 = 2\Delta r \tan(\alpha).$$

The upper working roller 3 is in this case displaced to the right and the lower working roller 4 to the left.

As can be seen from the right-hand partial image from FIG. 5, this method has the effect that the distance between the contour of the strip 1 between the two edges and the contour of the strip 1 at the edges increases over time. In other words, the effective contour of the working rollers 3, 4 becomes steeper or the effective contour of the working rollers 3, 4 is increased.

In FIGS. 3*b*, 3*c*, 4*b* and 4*c*, a part of the non-worn running surface 8 of the upper working roller 3 is illustrated by dashed lines. The distance between the non-worn and the worn running surface 8 gives the wear Δr in the radial direction.

FIG. 6 shows the geometrical definition of the pitch angle a of the conical portion 7 of a working roller 3, 4.

Although the invention has been illustrated more specifically and described in detail by the preferred exemplary embodiment, the invention is not restricted by the examples disclosed and other variations may be derived therefrom by a person skilled in the art without departing from the scope of protection of the invention.

LIST OF REFERENCE DESIGNATIONS

1 Strip
2, 2*a* . . . 2*e* Roll stand
3 Upper working roller
4 Lower working roller
5 End of a working roller
6 Chock
7 Conical portion
8 Running surface
9 Displacing device
11 Device for determining the wear or the rate of wear
12 Measuring instrument for determining the profile and/or the planarity
13 Control device for axially displacing the upper working roller and the lower working roller
16 Adjusting device
17 Roller table
18 Cooling section
F Rolling force
PRdesired Desired profile
PRactual Actual profile
r Radius
R Radial direction
Δr Wear of the running surface in the radial direction
Δ'r Rate of wear of the running surface in the radial direction
S Displacement distance
sextent Distance covered by the working roller
V Displacement rate
X Axial direction
α Pitch angle of the conical portion
0̇ First time derivative

What is claimed is:

1. An apparatus for changing an effective contour of a running surface of a working roller in a roll stand during hot rolling of rolling stock in the roll stand to form a rolled strip, wherein the roll stand comprises:

an upper working roller and a lower working roller, wherein each working roller has two ends for rotational mounting of the working roller in chocks;

wherein each working roller in the axial direction has a conical portion followed by a running surface;

wherein the running surfaces of the working rollers have a non-cylindrical initial contour prior to the hot rolling;

wherein the upper working roller is fitted in the opposite direction to the lower working roller and is axially displaceable so that the conical portion thereof is positioned opposite the running surface of the lower working roller;

wherein the lower working roller is axially displaceable so that the conical portion thereof is positioned opposite the running surface of the upper working roller;

a respective separate displacing device for the upper working roller and for the lower working roller for axial displacement of the working roller;

a device for determining at least one of the wear Δr or the rate of wear Δr of the running surface of at least one working roller in the radial direction;

a measuring instrument for determining the profile (PRactual) and/or the planarity of the rolled strip, wherein the measuring instrument is arranged downstream of the roll stand in the direction of mass flow; and a control device for axially displacing the working rollers in opposite directions in dependence on the wear Δr or the rate of wear Δr of the working rollers and on the measured profile (PRactual) and/or the measured planarity of the rolled strip so that the conical portion of the upper working roller is positioned opposite the running surface of the lower working lower and the conical portion of the lower working roller is positioned opposite the running surface of the upper working roller to flatten or reduce the working rollers' effective contour, and wherein the control device is connected in signaling terms to the device for determining the wear Δr or the rate of wear Δr and to the measuring instrument.

2. The apparatus as claimed in claim 1, further comprising the device for determining the wear Δr or the rate of wear Δr of the running surface is connected to a thickness measuring device operable for measuring the thickness of the rolled strip and is connected to a device for determining the distance between the upper working roller and the lower working roller.

3. The apparatus as claimed in claim 1, further comprising the device for determining the wear or the rate of wear Δr of the running surface has a wear model which, wherein the wear model is connected at least to one from the group comprising a rolling force measuring instrument for determining the rolling force F, the distance covered by the working roller Sextent and a timer for determining the rolling time.

4. The apparatus as claimed in claim 1, further comprising the displacing device is an electromechanical or hydraulic displacing device.

5. The apparatus as claimed in claim 1, further comprising the initial contour of a running surface of a working roller is a parabolic contour having a depth of 100 to 300 μm, wherein the axially central region of at least one of the working rollers is thinner than a peripheral region of the parabolic contour.

* * * * *